United States Patent [19]

Budrys et al.

[11] 3,989,908

[45] Nov. 2, 1976

[54] SPEAKER SUPERVISION IN A PUBLIC ADDRESS SYSTEM

[75] Inventors: Ignas Budrys, Bethel; Robert W. Right, Huntington, both of Conn.

[73] Assignee: General Signal Corporation, Rochester, N.Y.

[22] Filed: June 26, 1975

[21] Appl. No.: 590,654

[52] U.S. Cl. ..... 179/175.1 A; 179/175.3 R; 179/1 MN; 340/409

[51] Int. Cl.[2] ..... H04R 29/00

[58] Field of Search ..... 179/175.1 A, 175.3 R, 179/1 MN; 340/409, 214, 253 R, 253 B; 324/51

[56] References Cited

UNITED STATES PATENTS

| | | | |
|---|---|---|---|
| 3,161,731 | 12/1964 | Seeley | 340/409 |
| 3,656,158 | 4/1972 | Goodwater | 340/409 |
| 3,849,772 | 11/1974 | Burnett | 324/51 |
| 3,855,415 | 12/1974 | Fox et al. | 179/1 MN |
| 3,912,883 | 10/1975 | Goodyear | 179/175.3 R |

FOREIGN PATENTS OR APPLICATIONS

| | | | |
|---|---|---|---|
| 44-20407 | 9/1969 | Japan | 179/1 MN |

*Primary Examiner*—Douglas W. Olms
*Attorney, Agent, or Firm*—Milton E. Kleinman; John Ohlandt

[57] ABSTRACT

Apparatus and technique for supervising a public address system such that any faults on the lines connected to speakers in the system or any faults within the speaker structures can be detected and suitable corrective action can be taken. To accomplish this purpose, only three wires or lines need be taken or extended to each zone within the public address system.

8 Claims, 2 Drawing Figures

SPEAKER SUPERVISION IN A PUBLIC ADDRESS SYSTEM

BACKGROUND, OBJECTS AND SUMMARY OF THE INVENTION

The present invention relates to supervisory apparatus and technique and, more particularly, to a scheme that is capable of continuously supervising a public address system so as to ascertain whether there are faults such as opens or shorts due to failure of the wiring, that is, of the lines of the system, and also whether or not there is any failure connected with the speaker structures.

In general, it has been known to provide certain supervisory techniques in connection with the operation of public address systems or the like. These techniques are provided because it is often extremely important to know in certain kinds of systems that are to be relied on for transmitting crucial emergency or warning signals to occupants of a building that the systems remain capable of functioning properly at all times. To this end, it is common to transmit a supervisory tone or the like — generally above the normal hearing spectrum — and to monitor any substantial impedance changes due to open or short circuit conditions.

However, a fundamental problem occurs in the attempt to supervise or monitor a public address system in that the conventional speaker impedances are very slight, being of the order of 8 ohms, and since such small impedance speakers are connected in parallel it is virtually impossible to tell, within the context of a standard two-wire transmission loop, that a failure has occurred in the speaker itself; that is to say, somewhere within the coil structure of the speaker or the associated transformer, rather than in the wires forming the loop. Thus, the majority of prior art systems of simple construction cannot successfully ascertain and pinpoint a failure within a speaker of a public address system since they are designed chiefly to sense only a substantial change in impedance, and concomitant change of current, in the transmission loop.

Accordingly, it is the major object of the present invention to enable supervision of a public address system such that any fault in the lines or transmission loops or paths, including failures within the speakers themselves, can be pin-pointed.

Another object is to accomplish the preceding object with a minimum of cost.

Another object is to realize the supervision of a public address system in such a way that only three wires or lines are required to be extended to the speakers.

The above and other objects are fulfilled and implemented by a primary or principal feature of the present invention. In accordance with this feature, individual transmission loops are provided to each of a plurality of zones for the public address system. Only three wires or lines are extended from a central station to each of these zones; nevertheless, complete supervision of the wiring or lines to the speaker stations within each of the zones, as well as monitoring or supervision of each of the speaker coils and associated transformers, is accomplished.

In accordance with a more specific feature of the present invention, a high frequency generator, that is, one capable of generating a frequency above the normal audible range, for example, approximately 25,000 cycles, is connected to a suitable amplifier at a central panel or station. At the same panel, a speaker wiring supervision means is provided and is connected to each of the zones in the public address system. The speaker wiring supervision means includes an arrangement which response to either a short or open anywhere in the wiring and, by additional means to be described, responds to a fault in the speaker itself. The supervision means is provided at its output with a trouble light or other signal. As a result, the operator is alerted to such failure and can proceed to the zone indicated by the particular trouble lamp, where be can then ascertain the particular location within that zone at which the fault has occurred.

In accordance with the above, any fault in the wiring, whether it be an open or short, will be detected. Moreover, there is included in the system, for the specific purpose of supervising or monitoring faults within the speakers themselves, a special module or assembly at each speaker location in each of the zones. Thus, for each speaker a detection arrangement is provided so as to sense whether or not the speaker coil is operative. This mechanism includes a magnetic pick-up spaced adjacent the speaker coil and connected to an amplification system and thence to a relay which is deactivated in the event that the speaker coil is sensed as either short or open. Operation of such relay permits the open or short circuited speaker coil to register or indicate that it is in a fault state. In other words, that speaker acts as any other failure or fault would in respect to the effect on the supervision means at the central station. However, a continuous path remains for transmission of audio frequencies. Thus, corrective action can be taken and the fault can be pin-pointed by reason of the fact that, despite the fault in a given speaker or speakers, an audible signal can be transmitted over the remaining speakers of that zone.

Other and further objects, advantages and features of the present invention will be understood by reference to the following specification in conjunction with the annexed drawings, wherein like parts have been given like numbers.

DESCRIPTION OF PREFERRED EMBODIMENT

Figure 1:
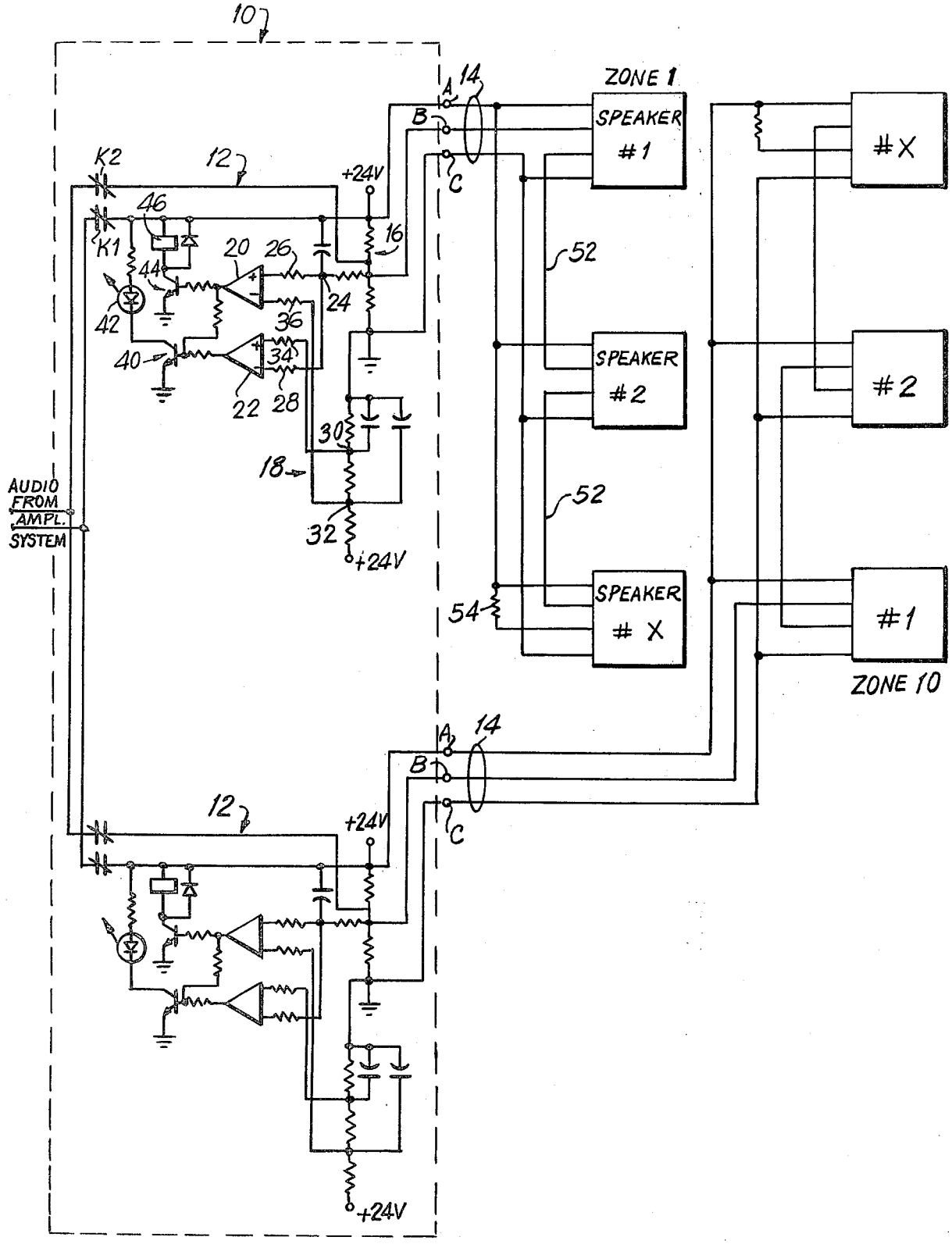
FIG. 1 is a block-schematic diagram illustrating a preferred embodiment for the speaker supervision apparatus of the present invention.

Referring now to the figures of the drawings and, in particular for the moment, to FIG. 1, there is first depicted in block-schematic form the entire system of the present invention. It will be noted that there are provided at a central station 10 two supervision means or devices 12, each of these supervising means 12 being connected to three lines forming transmission paths 14 which extend respectively to two typical zones, that is, to zone 1 and to zone 10 as indicated.

The paths 14 are connected to three terminals A, B, C, in each case, that is, to each of the supervising means 12. Within each of the blocks indicated by numeral 12 there is provided a detection apparatus, comprising essentially potentiometer or dividing networks 16 and 18, respectively, from which connections are made to comparators 20 and 22. It will be particularly noted that connection is made from junction point 24, by means of suitable resistors 26 and 28 respectively, to first inputs of the respective comparators. Moreover, that connection is made from separate junction points 30 and 32 on the network 18 to those same comparators; specifically, connection is made from junction 30 through a suitable resistor 34 to another input of comparator 22, whereas from junction 32, connection is made through resistor 36 to another input of comparator 20.

As will be understood, comparators 20 and 22 consist essentially of well-known operational amplifiers that can be used for this purpose. The comparator 22 operates to detect an open condition whenever this occurs; that is to say, the aforenoted arrangement is such that a prescribed voltage difference of approximately 9.6 volts exists between the terminals 2 and 3 of the comparator 22, whereby the output of such comparator becomes such as to turn on the transistor 40 thereby to produce illumination of trouble lamp 42 so as to indicate that the open condition exists.

On the other hand, let it be assumed that a short occurs somewhere along the transmission paths 14. Under such conditions, the comparator 20 senses a voltage difference of approximately 24 volts between its input terminals and consequently its output is affected such as to turn on transistor 44. This results in activating relay 46 such that contacts K1 and K2, which are normally closed, become opened. As a result, there is a simulated open condition across the terminals A and B and hence the result previously obtained is again effected, that is to say, the comparator 22 again senses this open condition and an indication is given by lamp 42.

Figure 2:
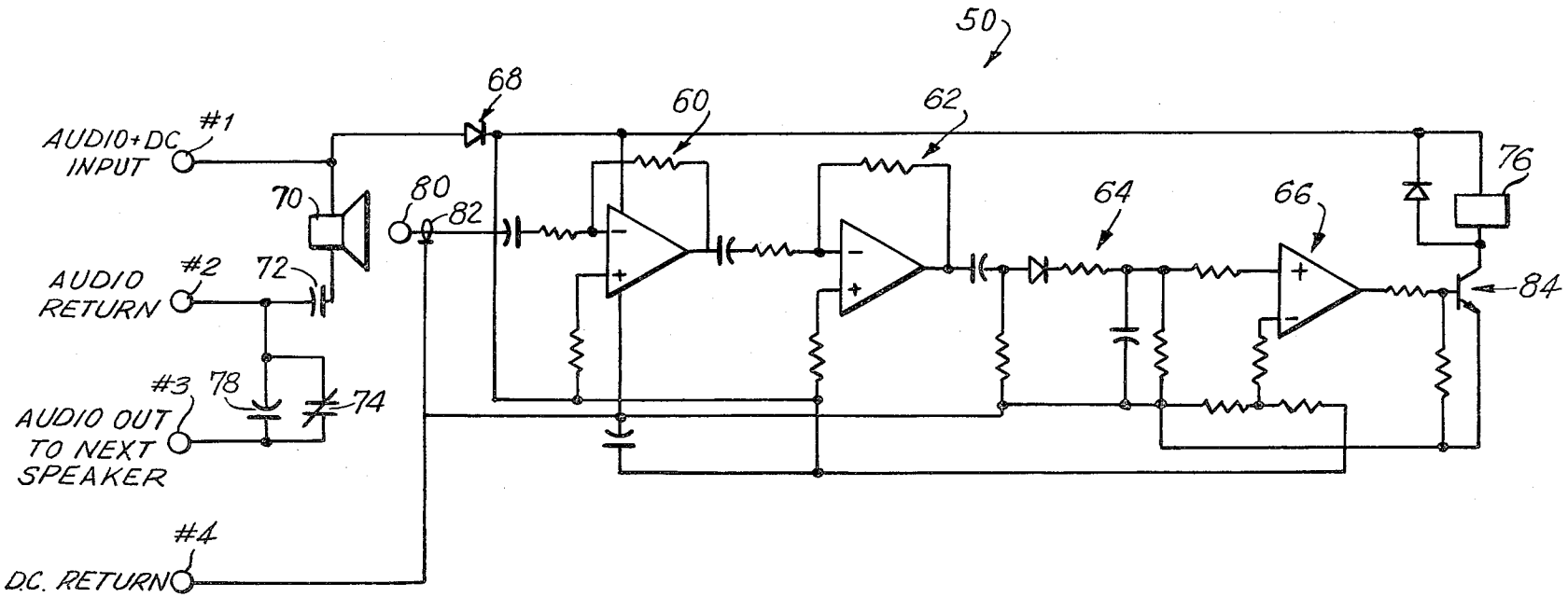
FIG. 2 is a schematic diagram of the speaker coil supervision module or assembly of the present invention.

Assuming now that a particular kind of fault occurs, that is, the kind which relates to a defect within a speaker structure somewhere in the system, reference to FIG. 2 will indicate how this fault is handled. It will be seen in FIG. 2 that a detection means 50 is specially adapted to respond to the generation of magnetic flux of the coil of a particular speaker 70 and to provide an output as will be explained.

First of all, it should be noted that the terminals as marked serve particular functions. Thus, terminal 1 serves for both the audio and DC input and it will be seen that this input is taken to the several elements constituting the detection means 50 is connected to terminal A by means of one of the lines 14. Terminal 2 serves for return audio, that is, it constitutes part of he return path for audio signals and is connected, as will be recalled from FIG. 1, to terminal B of the central station 10 by way of another of the lines 14.

Terminal 3 of any given speaker is connected by a suitable line 52 (FIG. 1) to terminal 2 of the next speaker in the group or array within a given zone. Thus, it will be understood that speakers Nos. 1, 2 and X in zone 1 are connected in parallel for audio signal transmission and similarly, speakers 1, 2 and X in zone 10 (FIG. 1) are also connected in parallel for audio signal transmission. Terminal 4 seen on the left in FIG. 2, serves for the DC return, that is to say, all of the speakers have a common return to ground by way of the last one of the lines 14 connected to these terminals 4.

It should also be noted that an end-of-line resistor 54 (FIG. 1) is also connected in parallel with the speakers of a given zone. Such use of an end-of-line resistor is in itself well-known, the function of such resistor being to have a large enough value such that an open condition anywhere in the lines or a short circuit condition will result in a substantial impedance change as sensed by the detection or supervision means at the central station. Thus, for example, regardless of the point along the lines at which an open condition occurs, this condition will always be reflected by a substantial or significant impedance change rather than by a slight change as would occur possibly if no end-of-line resistor were used.

As seen in FIG. 2, the specific circuitry for the detection means 50 involves an arrangement of several amplifiers 60 and 62, an integrator 64 and a level detector 66. As noted previously, the DC power supply for these components is established by way of the terminal 1, which is connected to +24 volts at central station 10, and by the regulating diode 68 which allows for the flow of DC only to these components. On the other hand, DC does not reach the speaker device 70 inasmuch as a DC blocking capacitor 72 is provided in circuit with that speaker. Thus it will be apparent that audio signals supplied to a normally operating speaker 70 will flow by way of terminals 1 and 2 and the appropriate lines 14.

It should also be noted that relay contacts 74, operated by relay 76, are in shunt with a capacitor 78. The contacts 74 are normally closed.

Operation of the detection means 50 is in response to the generation of magnetic flux of the coil of speaker 70. It will be seen that a magnetic pick-up 80 is located in spaced relationship to speaker 70, the magnetic pick-up having a shield wire 82 connected to ground by way of terminal 4. Any alternating current of the speaker coil results in the generation of a significant voltage within the magnetic pick-up 80. The eventual result or consequence is that an output transistor 84, at the end of the cascade or chain of the several amplifiers, integrator and level detector, is kept in its normal or ON state. Should there be only a very slight momentary interruption of coil flux, the transistor 84 will remain in the ON state due to the effect of the integrator 64. However, should there be a cessation of flux of the coil of speaker 70 for a significant interval, then transistor 84 will be turned OFF and relay 76 will be deactivated. Deactivation of this relay results in opening the normally closed contact 74 of that relay and this means, of course, that the capacitor 78 no longer has a short across it, whereby it becomes effective to transmit only alternating signals of appropriate frequencies.

Accordingly, it will be appreciated that under normal circumstances, that is, there being present no short or open within the speaker structure itself, the magnetic pick-up will generate a sufficient signal such that contacts 74 remain closed and hence all of the speakers operate normally with minimal impedance in respect to their interconnections, that is, they function in parallel without any intervening high impedance. However, when any speaker 70 has a fault in the nature of a short or open, that fault will be sensed by the supervision means 12 at the central station; nevertheless, audio signals can still be transmitted to the other speakers that are not suffering from any faults. This enables continuous supervision of all of the speakers in the zone and it also permits transmitting an audible frequency to the zone in which a speaker has been indicated to be faulty. Consequently, an operator can go to that zone and determine which speaker or speakers are affected, that is, are suffering from the fault.

While there has been shown and described what is considered at present to be the preferred embodiment of the present inventon, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. Apparatus for supervising a public address system such that any faults on the lines connected to speakers in the system or any faults within the speaker structures can be detected, comprising a central station;

groups of speakers in each of a plurality of zones;

a supervision means for each zone to be supervised, including connections by way of a three-line transmission path to the group of speakers in a respective zone;

said supervision means including a first comparator connected to said transmission path and responsive at its input to substantial changes in the impedance of said transmission path, due to an open circuit condition, to indicate such condition;

a relay having contacts in two of said lines;

a second comparator connected to said transmission path and responsive at its input to substantial changes in the impedance of said transmission path, due to a short circuit condition, the second comparator being operative to open said relay contacts so as to present an open condition, whereupon the first comparator is responsive to each open condition.

2. Apparatus as defined in claim 1, further comprising a detection means at each of said speakers so that faults occurring within the speakers themselves can be indicated at said central station.

3. Apparatus as defined in claim 2, further comprising first, second, third and fourth terminals at each speaker location, the first terminal being connected to the first line which is a combined audio and DC input line, the second terminal being connected to the second line which is an audio return line and the fourth terminal being connected to a DC return line, the third terminal serving to interconnect speakers so that they are all connected to said audio return line.

4. Apparatus as defined in claim 3, further comprising a capacitor and a pair of relay contacts connected in parallel, the relay contacts being normally closed such that the capacitor is short circuited, the parallel combination being connected between said second and third terminals for each speaker.

5. Apparatus as defined in claim 4, further comprising a cascade arrangement of at least one amplifier, an integrator and a level detector, the output of the level detector being connected to a relay;

a magnetic pick-up connected to an input of said amplifier.

6. Apparatus as defined in claim 5, in which said magnetic pick-up is disposed in spaced relationship from said speaker and in which said amplifier, integrator and level detector receive their DC power supply from the audio and DC input line connected thereto.

7. Apparatus as defined in claim 6, in which one side of said speaker is connected to said first line and a second capacitor is connected in series with said speaker and is further connected to said audio return line.

8. Apparatus as defined in claim 7, in which operation of said relay produces opening of said relay contacts such that audio signal current flows through said first capacitor to all of the other non-faulted speakers in a predetermined zone responsive to the occurrence of a fault in any one of the speakers in that zone.

* * * * *

UNITED STATES PATENT OFFICE

CERTIFICATE OF CORRECTION

PATENT NO. : 3,989,908

DATED : November 2, 1976

INVENTOR(S) : Ignas Budrys and Robert W. Right

It is certified that error appears in the above-identified patent and that said Letters Patent are hereby corrected as shown below:

Column 5, line 31, delete "each" and substitute --such--.

Signed and Sealed this

*Twenty-sixth* Day of *February 1980*

[SEAL]

*Attest:*

SIDNEY A. DIAMOND

*Attesting Officer*

*Commissioner of Patents and Trademarks*